US010971093B2

(12) United States Patent
Xi et al.

(10) Patent No.: US 10,971,093 B2
(45) Date of Patent: Apr. 6, 2021

(54) PIXEL CIRCUIT AND DISPLAY DEVICE

(71) Applicant: AU OPTRONICS CORPORATION, Hsin-Chu (TW)

(72) Inventors: Peng-Bo Xi, Hsin-Chu (TW); Sung-Yu Su, Hsin-Chu (TW); Chen-Feng Fan, Hsin-Chu (TW); Wan-Heng Chang, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/239,686

(22) Filed: Jan. 4, 2019

(65) Prior Publication Data

US 2019/0213967 A1 Jul. 11, 2019

(30) Foreign Application Priority Data

Jan. 5, 2018 (TW) ..... 107100509

(51) Int. Cl.
*G09G 3/36* (2006.01)

(52) U.S. Cl.
CPC ..... *G09G 3/3648* (2013.01); *G09G 3/3614* (2013.01); *G09G 2300/0478* (2013.01); *G09G 2300/0871* (2013.01); *G09G 2320/0252* (2013.01)

(58) Field of Classification Search
CPC ..... G09G 3/3648; G09G 3/3614; G09G 2300/0478; G09G 2300/0871; G09G 2320/0252
See application file for complete search history.

(56) References Cited

U.S. PATENT DOCUMENTS

| | | | | |
|---|---|---|---|---|
| 6,859,194 | B2 | 2/2005 | Aoyama et al. | |
| 8,232,946 | B2 | 7/2012 | Kim et al. | |
| 9,867,257 | B2 * | 1/2018 | Nathan | G09G 3/3241 |
| 2008/0309840 | A1 | 12/2008 | Yen et al. | |
| 2015/0277177 | A1 * | 10/2015 | Lin | G09G 3/3648 345/209 |

OTHER PUBLICATIONS

Office Action for the corresponding China application issued by SIPO dated Apr. 15, 2020.

* cited by examiner

*Primary Examiner* — Kenneth B Lee, Jr.
(74) *Attorney, Agent, or Firm* — WPAT, PC

(57) ABSTRACT

A pixel circuit includes a storage capacitor, a first switch, and a second switch. The first switch is electrically connected to a first end of the storage capacitor, and configured to provide a data voltage to the first end of the storage capacitor according to a gate signal. The second switch is electrically connected between the first end of the storage capacitor and a second end of the storage capacitor, and configured to receive a first operating voltage from the second end of the storage capacitor and provide the first operating voltage to the first end of the storage capacitor.

20 Claims, 11 Drawing Sheets

PIXEL CIRCUIT AND DISPLAY DEVICE

RELATED APPLICATIONS

This application claims priority to Taiwan Application Serial Number 107100509, filed Jan. 5, 2018, which is herein incorporated by reference.

BACKGROUND

Technical Field

The present disclosure relates to an electronic circuit and an electronic device. Particularly, the present disclosure relates to a pixel circuit and a display device.

Description of Related Art

With advances in electronic technology, display devices, such as mobile phones or computers, have been widely used in people's daily lives.

Generally, a display device may include a plurality of the electrodes and a display layer. The display device provides different voltages to these electrodes; therefore an electric field can be created between these electrodes to twist the display components of the display layer. By controlling the twist angle of the display components, the image display of the display device can be controlled.

Therefore, how to provide the voltage to these electrodes to control the twist angle of the display components is an important research topic in this field.

SUMMARY

One aspect of the present disclosure is related to a pixel circuit. In accordance with one embodiment of the present disclosure, the pixel circuit includes a storage capacitor, a first switch, and a second switch. A first switch is electrically connected to a first end of the storage capacitor and is configured to provide a data voltage to the first end of the storage capacitor according to a gate signal. A second switch is electrically connected between the first end of the storage capacitor and a second end of the storage capacitor, and is configured to receive a first operating voltage from the second end of the storage capacitor and provide the first operating voltage to the first end of the storage capacitor.

One aspect of the present disclosure is related to a pixel circuit. In accordance with one embodiment of the present disclosure, the pixel circuit includes a pixel electrode, an array-side electrode, a first switch, and a second switch. The pixel electrode and the array-side electrode is disposed at a first side of a display layer. A first switch configured to provide a data voltage to the pixel electrode. A second switch electrically connected between the pixel electrode and the array-side electrode, and configured to provide a first operating voltage on the array-side electrode to the pixel electrode to make axial directions of a plurality of display components in the display layer be substantially perpendicular to the pixel electrode.

Another aspect of the present disclosure is related to a display device. In accordance with one embodiment of the present disclosure, a display device includes a display layer, a pixel electrode, an array-side electrode, a first switch, and a second switch. The pixel electrode and the array-side electrode are disposed at a first side of a display layer, and there is a storage capacitor between the pixel electrode and the array-side electrode. The first switch is configured to provide a data voltage to the pixel electrode. A second switch is electrically connected between the pixel electrode and the array-side electrode, and is configured to provide a first operating voltage on the array-side electrode to the pixel electrode to make axial directions of a plurality of display components in the display layer be substantially perpendicular to the pixel electrode.

Through the application of one embodiment described above, an electric circuit can be implemented. Through applying such a pixel circuit in the display device, the display components can be twisted quickly to decrease the screen response time of the display device.

DETAILED DESCRIPTION

Figure 1:
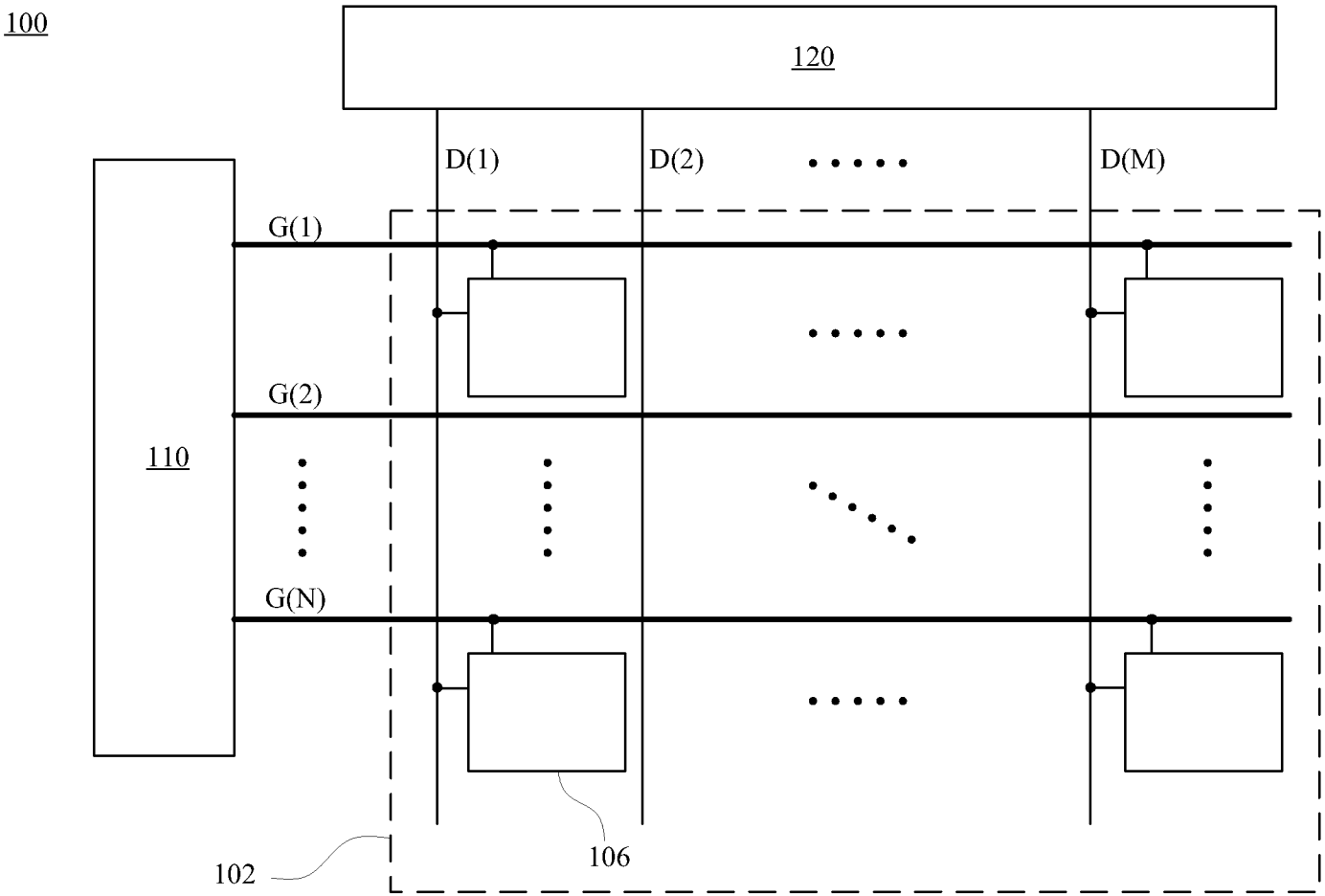
FIG. 1 illustrates a schematic diagram of a display device in accordance with one embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

It will be understood that, in the description herein and throughout the claims that follow, although the terms "first," "second," etc. may be used to describe various elements, these elements should not be limited by these terms. These terms are only used to distinguish one element from another. For example, a first element could be termed a second element, and, similarly, a second element could be termed a first element, without departing from the scope of the embodiments.

It will be understood that, in the description herein and throughout the claims that follow, when an element is referred to as being "electrically connected" or "electrically coupled" to another element, it can be directly connected or coupled to the other element or intervening elements may be present. In contrast, when an element is referred to as being "directly connected" or "directly coupled" to another element, there are no intervening elements present. Moreover, "electrically connect" or "connect" can further refer to the interoperation or interaction between two or more elements.

It will be understood that, in the description herein and throughout the claims that follow, the terms "comprise" or "comprising," "include" or "including," "have" or "having," "contain" or "containing" and the like used herein are to be understood to be open-ended, i.e., to mean including but not limited to.

It will be understood that, in the description herein and throughout the claims that follow, the phrase "and/or" includes any and all combinations of one or more of the associated listed items.

It will be understood that, in the description herein and throughout the claims that follow, unless otherwise defined, all terms (including technical and scientific terms) have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any element in a claim that does not explicitly state "means for" performing a specified function, or "step for" performing a specific function, is not to be interpreted as a "means" or "step" clause as specified in 35 U.S.C. § 112(f). In particular, the use of "step of" in the claims herein is not intended to invoke the provisions of 35 U.S.C. § 112(f).

FIG. 1 illustrates a schematic diagram of a display device 100 in accordance with one embodiment of the present disclosure. The display device 100 includes a gate driver circuit 110, a source driver circuit 120, and a pixel array 102. The pixel array 102 includes a plurality of pixel circuits 106 arranged in a matrix. The gate drive circuit 110 is configured to sequentially generate a plurality of gate signals G(1) to G(N) and provide these gate signals G(1) to G(N) to the pixel circuits 106 of the pixel array 102 to turn on the switches (e.g., the switch T1 shown in FIG. 2) of the pixel circuits 106 row by row, where N is a natural number. The source driver circuit 120 is configured to generate a plurality of data voltages D(1) to D(M), and provide the data voltages D(1) to D(M) to the pixel circuits 106 with the turned-on switches to perform the display operation according to the data voltages D(1) to D(M), where M is a natural number. Thereby, the display device 100 is able to display images.

Figure 2:
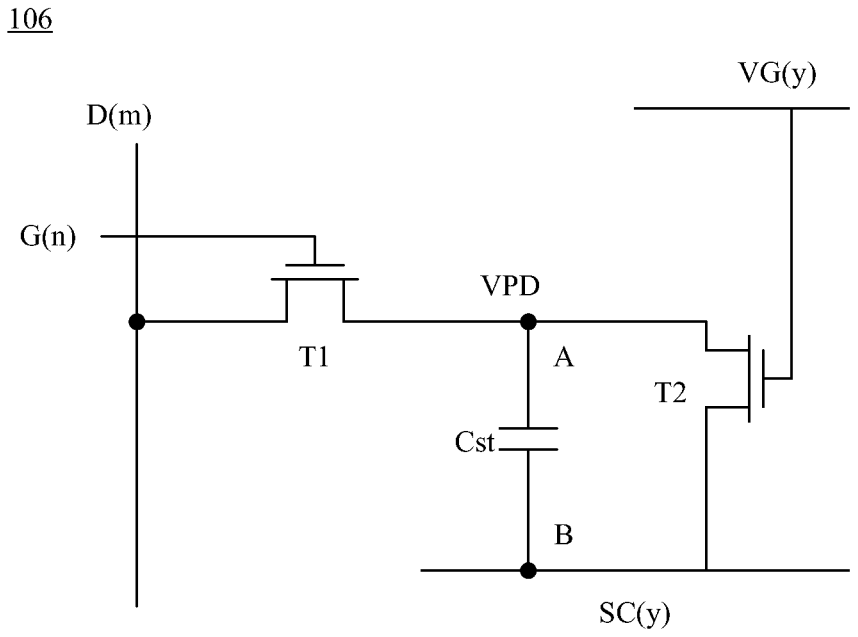
FIG. 2 illustrates a schematic diagram of a pixel circuit in accordance with one embodiment of the present disclosure.

FIG. 2 illustrates a schematic diagram of a pixel circuit 106 in accordance with one embodiment of the present disclosure. In this embodiment, the pixel circuits 106 receive the gate signal G(n), the data voltage D(m), and the control signal VG(y). The gate signal G(n) is one of the gate signals G(1) to G(N) described above, and the data voltage D(m) is one of the data voltages D(1) to D(M) described above.

In this embodiment, the pixel circuits 106 include the switches T1 to T2, and the storage capacitor Cst. In one embodiment, the switches T1 to T2 can be implemented by a thin film transistor. However, other types of switches are also in the scope of the present disclosure. In one embodiment, the switches T1 and T2 can be implemented by NPN-type transistors. However, the present disclosure is not limited to this embodiment. In different embodiments, the switches T1 to T2 can be implemented by PNP-type transistors according to the actual requirements. In one embodiment, the storage capacitor Cst can be implemented by a pixel electrode (e.g. the pixel electrode PD in FIG. 4) and an array-side electrode (e.g. the array-side electrode ACM in FIG. 4), for example, the storage capacitor Cst can be a plate capacitor between the pixel electrode and the array-side electrode. However, the present disclosure is not limited to this embodiment.

In this embodiment, the first end of the switch T1 is configured to receive the data voltage D(m), the second end of the switch T1 is electrically connected to the first end of the storage capacitor Cst (hereinafter referred to as "node A"), and the control end of the switch T1 is configured to be turned on according to the gate signal G(n) to provide the data voltage D(m) to node A.

The first end of the switch T2 is electrically connected to node A, the second end of the switch T2 is electrically connected to the second end of the storage capacitor Cst (hereinafter referred to as "node B"), and the control end of the switch T2 is configured to receive to the control signal VG(y). In one embodiment, the switch T2 is configured to be turned on according to the control signal VG(y) to provide the voltage SC(y) of node B to node A.

In one embodiment, the first end of the storage capacitor Cst (i.e. node A) is electrically connected to the pixel electrode, and the second end of the storage capacitor Cst (i.e. node B) is electrically connected to the array-side electrode, so that the switch T2 can be configured to provide the voltage SC(y) of the array-side electrode to the pixel electrode according to the control signal VG(y).

In one embodiment, the voltage SC(y) of the array-side electrode has a first voltage level (e.g. +8V) (hereinafter, the voltage SC(y) having the first voltage level is referred to as the first operating voltage VOP1), a second voltage level (e.g. −8V)(hereinafter, the voltage SC(y) having the second voltage level is referred to as the second operating voltage VOP2), or a third voltage level (e.g. 0V)(hereinafter, the voltage SC(y) having the third voltage level is referred to as the third operating voltage VOP3). The switch T2 alternatively provides the first operating voltage VOP1 and the second operating voltage VOP2 to the pixel electrode to reverse polarity. However, in different embodiments, the operation of the reverse polarity described above can also be omitted according the actual requirements.

In the paragraphs below, operations of the pixel circuits 106 in an operative embodiment will be described with reference to FIG. 3 to FIG. 7.

Figure 3:
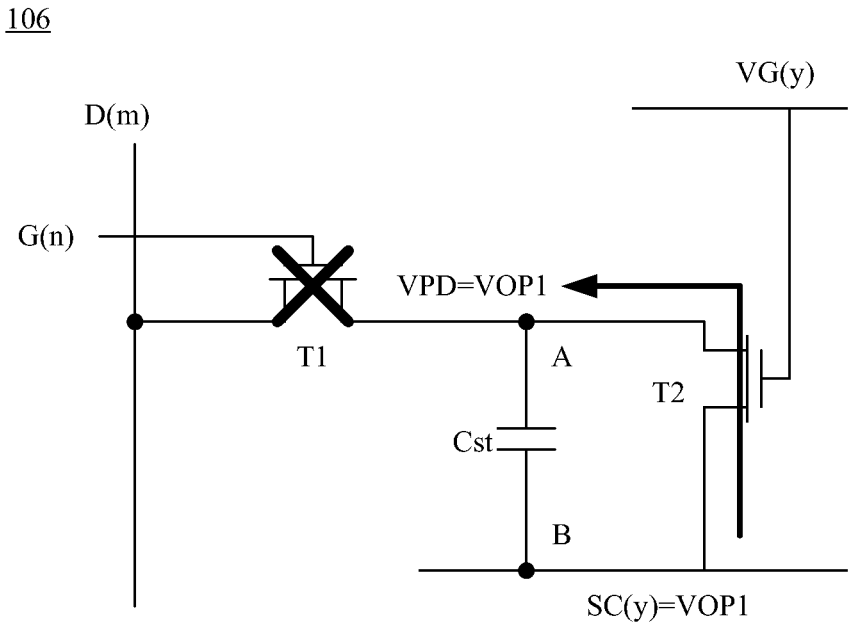
FIG. 3 illustrates an exemplary operation of a pixel circuit in accordance with one embodiment of the present disclosure.
Figure 4:
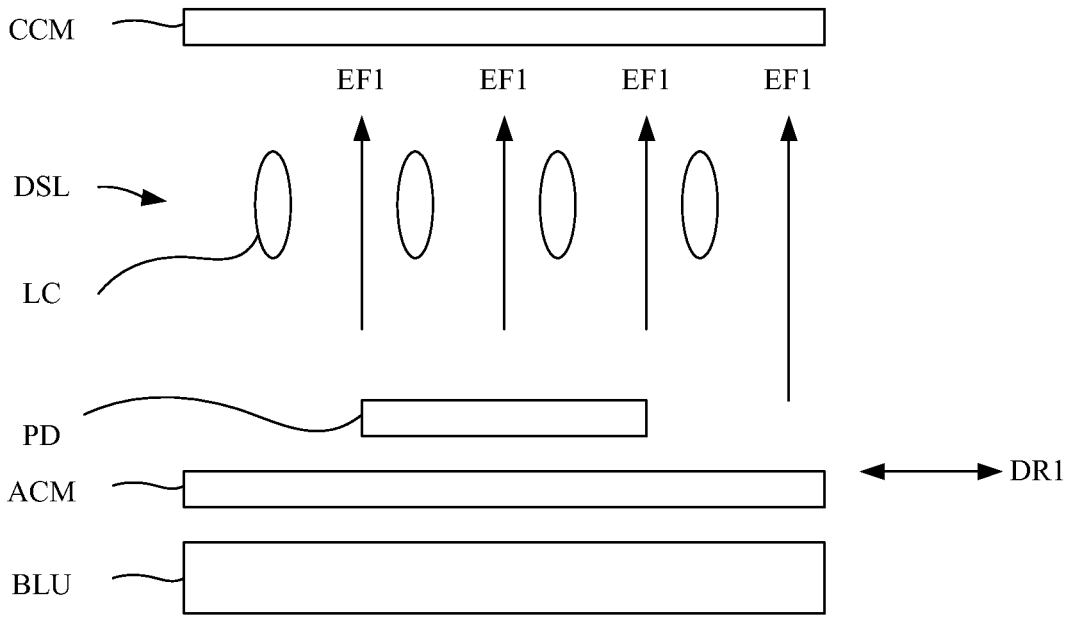
FIG. 4 illustrates an exemplary operation of a display device in accordance with one embodiment of the present disclosure.
Figure 7:
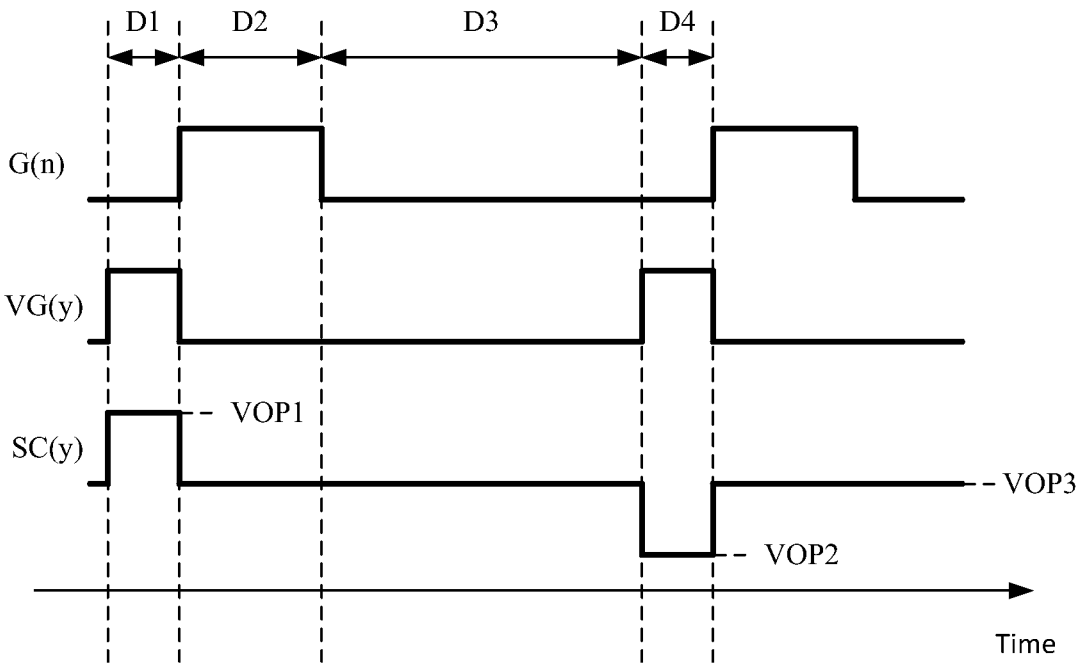
FIG. 7 illustrates signals of a pixel circuit in accordance with one embodiment of the present disclosure.

Referring to FIG. 3, FIG. 4, and FIG. 7, during the period D1 (e.g. the vertical electric field stage), the gate signal G(n) has a low voltage level (e.g. −6.5V), and the control signal VG(y) has a high voltage level (e.g. 10V), and the voltage SC(y) of the array-side electrode ACM is the first operating voltage VOP1.

At this time, the switch T1 is turned off according to the gate signal G(n) to prevent the data voltage D(m) from being provided to node A (referred to as the pixel electrode PD). The switch T2 is turned on according to the control signal VG(y) to provide the first operating voltage VOP1 of the array-side electrode ACM to node A to make the voltage VPD on the pixel electrode PD equal to the first operating voltage VOP1.

At this time, if the voltage (e.g. voltage-to-ground) of the counter electrode CCM is different from the first operating voltage VOP1, a first electric field EF1 is created between the array-side electrode ACM and the counter electrode CCM, and between the pixel electrode PD and the counter electrode CCM. In this embodiment, the direction of the first electric field EF1 is from the array-side electrode ACM to the counter electrode CCM, and the direction of first electric field EF1 is substantially perpendicular to the extension direction DR1 of the array-side electrode ACM and/or the pixel electrode PD.

In one embodiment, the first electric field EF1 makes a plurality of the display components LC (e.g. liquid crystal) in the display layer DSL which is disposed between the pixel electrode PD and the counter electrode CCM erect relative to the pixel electrode PD (e.g., a certain angle between the axial directions of the display components LC and the surface of the pixel electrode PD). In one embodiment, the first electric field EF1 makes the axial directions of display components LC is substantially in the same direction with the direction of the first electric field EF1, but not limited thereto.

Figure 5:
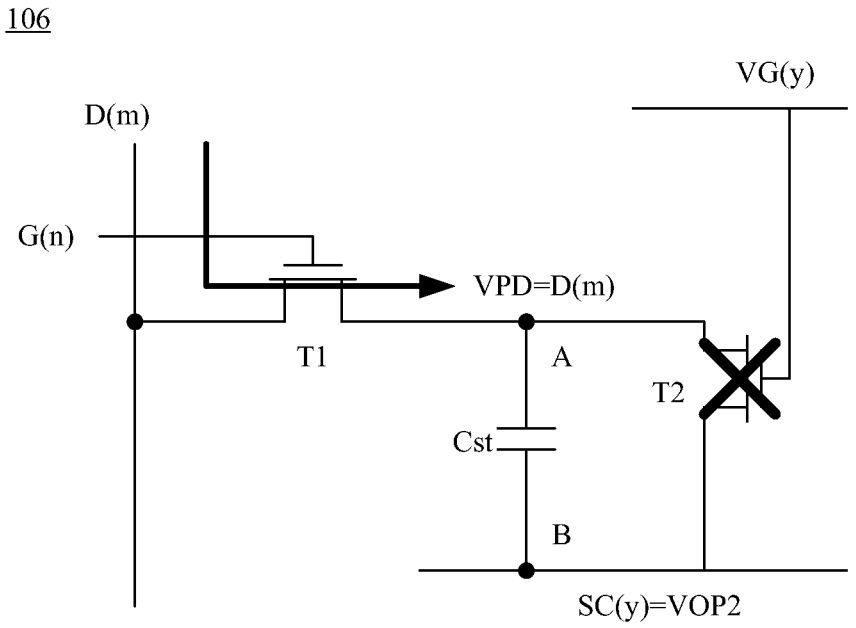
FIG. 5 illustrates an exemplary operation of a pixel circuit in accordance with one embodiment of the present disclosure.
Figure 6:
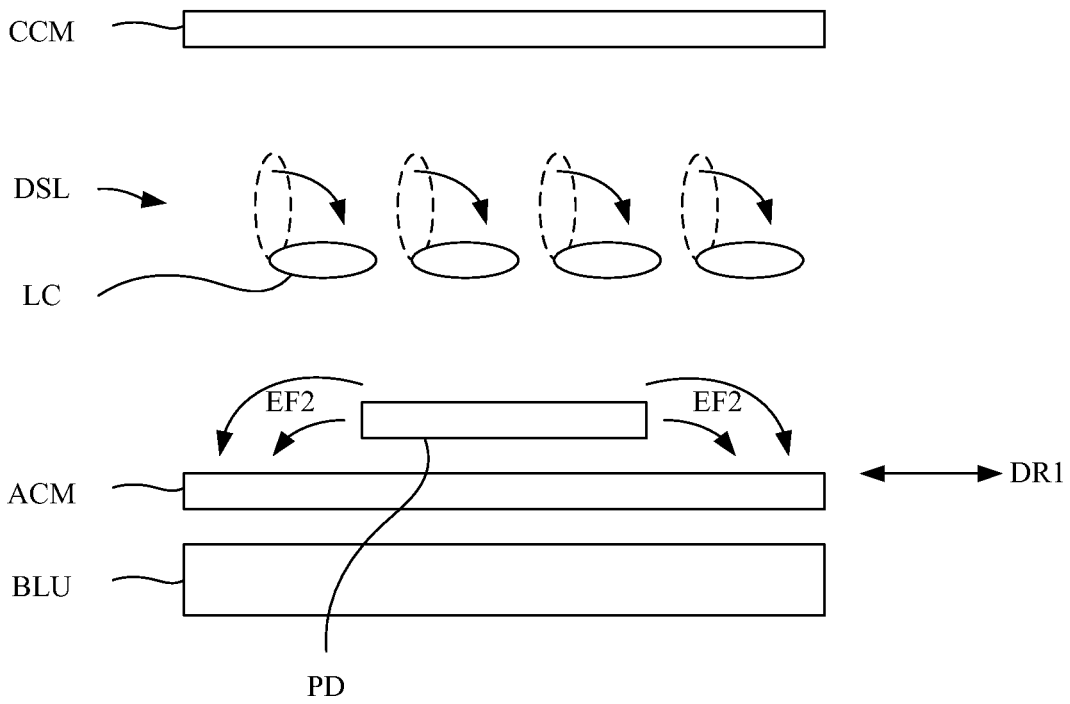
FIG. 6 illustrates an exemplary operation of a display device in accordance with one embodiment of the present disclosure.

Refer to FIG. 5, FIG. 6, and FIG. 7, during the period D2 (e.g. the data writing stage), the gate signal G(n) has the high voltage level (e.g. 10V), and the control signal VG(y) has the low voltage level (e.g. −6.5V), and the voltage SC(y) on the array-side electrode ACM is the third operating voltage VOP3.

At this time, the switch T2 is turned off according to the control signal VG(y) to prevent the third operating voltage VOP3 from being provided to node A (i.e. the pixel electrode PD) to make the voltage VPD on the pixel electrode PD equal to the data voltage D(m).

At this time, since the above-mentioned first electric field EF1 from the array-side electrode ACM to the counter electrode CCM has gone, the axial directions of the display components LC start to restore from the erect state relative to the pixel electrode PD (e.g., the display components LC are substantially perpendicular to the array-side electrode ACM and/or the pixel electrode PD) to be substantially horizontal to the extension direction DR1 of the array-side electrode ACM. At this moment, the second electric field EF2 generated between the pixel electrode PD with the data voltage D(m) and the array-side electrode ACM twists the display components LC to substantially paralleled to the extension direction DR1 of the array-side electrode ACM, the illumination of the backlight unit BDU can therefore be adjusted.

During the period D3 (e.g. the voltage maintaining stage), the gate signal G(n) has the low voltage levels (e.g. −6.5V), the control signal VG(y) has the low voltage levels (e.g. −6.5V), and the voltage SC(y) of the array-side electrode ACM is the third operating voltage VOP3.

At this time, the switch T1 is turned off according to the gate signal G(n), hence the new data voltage cannot be provided to node A. The switch T2 is turned off according to the control signal VG(y), hence the third operating voltage cannot be provided to node A. At this time, the voltage VPD on the pixel electrode PD maintains same as the data voltage D(m) during the period D2.

During the period D4 (e.g. the vertical electric field stage), the gate signal G(n) has the low voltage levels (e.g. −6.5V), the control signal VG(y) has the high voltage levels (e.g. 10V), and the voltage SC(y) of the array-side electrode ACM is the second operating voltage VOP2.

During the period D4, if the voltage on the counter electrode CCM (e.g. voltage-to-ground) is between the first operating voltage VOP1 and the second operating voltage VOP2, there is a third electric field substantially opposed to the first electric field EF1 between the array-side electrode ACM and the counter electrode CCM, and between the pixel electrode PD and the counter electrode CCM. In one embodiment, the third electric field makes the display components LC erect (e.g., erected relative to the pixel electrode (e.g., a certain angle between the axial directions of the display components LC and the pixel electrode PD)). In one embodiment, the third electric field makes the axial directions of the display components LC be substantially in the same direction with the direction of the third electric field EF3, but the present disclosure is not limited to this embodiment. The detail operation during the period D4 is substantially similar to the operation during the period D1, and please refer to the paragraph described above for details. Relative description in this regard will not be repeated herein.

Regarding the operation after the period D4, please also refer to the operation of the period D2 and D3 described above for detail. Relative description in this regard will not be repeated herein.

Through the operations described above, the display components LC erects relative to the pixel electrode PD first, then the display components LC may be twisted according to the data voltage D(m). In this way, the display components LC can be quickly twisted, so that the screen response time of the display device can be decreased.

It should be noted that, the values of the voltage described above are only used for exemplary purposes, and the present disclosure is not limited to the examples described above. Besides, the related terms like the vertical electric field described above can be referred to the first electric field EF1 and the third electric field EF3 that make the display components LC erect a certain angle (e.g. greater than 45 degrees) relative to the pixel electrode PD so that the display components LC can be twisted quickly. The first electric field EF1 and the third electric field EF3 can be designed according to the actual requirements, and are not limited to be perpendicular to the extension direction DR1 of the array-side electrode ACM and/or the pixel electrode PD.

Furthermore, the first operating voltage VOP1 described above, the second operating voltage VOP2, the voltage on the counter electrode CCM, and the length of time (e.g. the period D1 and D4) of the vertical electric field can be designed according to the actual requirements to make the display components LC erect a certain angle (e.g. greater than 45 degrees) relative to the pixel electrode PD in the vertical electric field stage. The related designs are not limited to the embodiments described above.

On the other hand, in different embodiments, during the period D4, the array-side electrode ACM may have the first operating voltage VOP1, that is different from the above embodiments.

Figure 8:
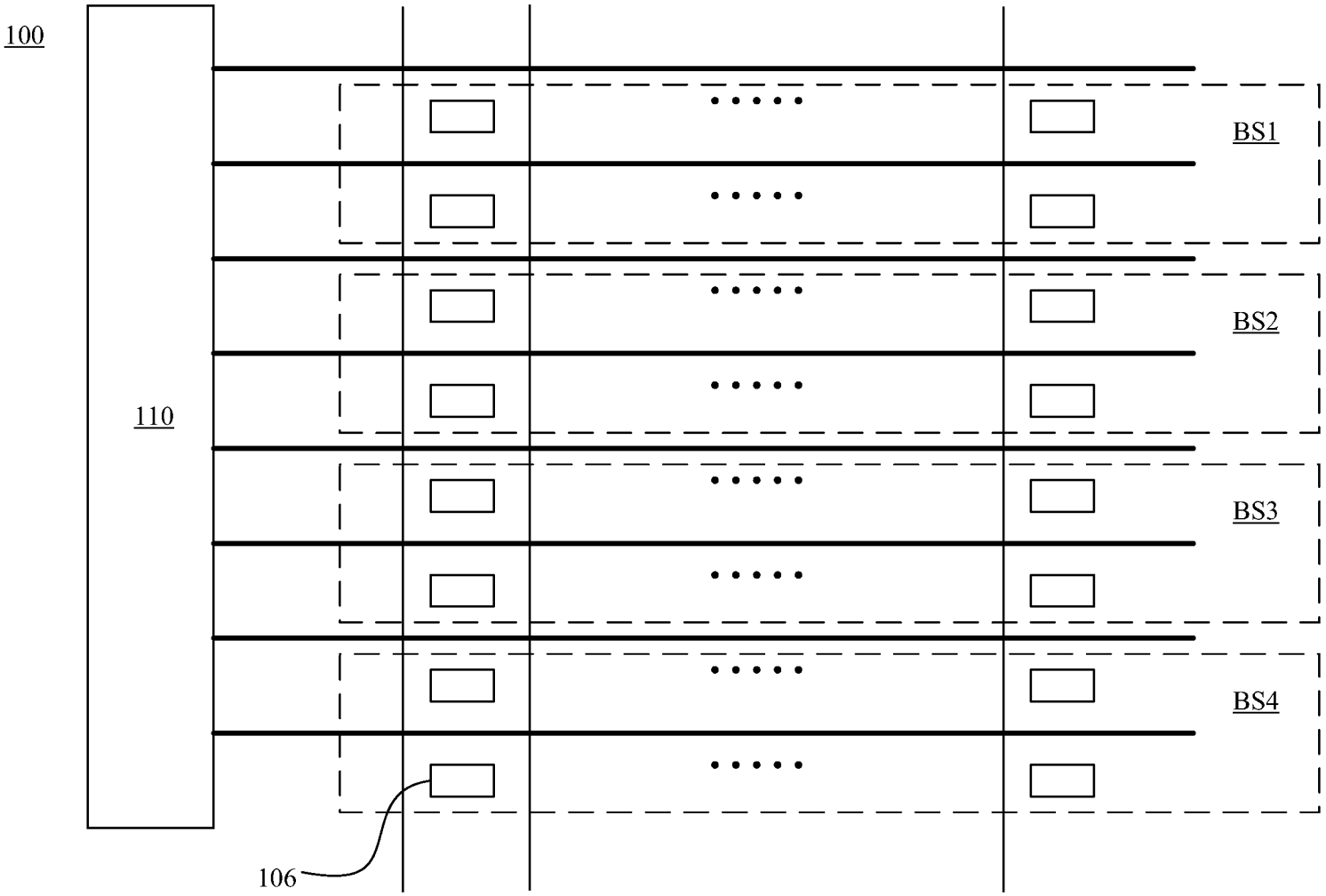
FIG. 8 illustrates an exemplary operation of a display device in accordance with another embodiment of the present disclosure.
Figure 9:
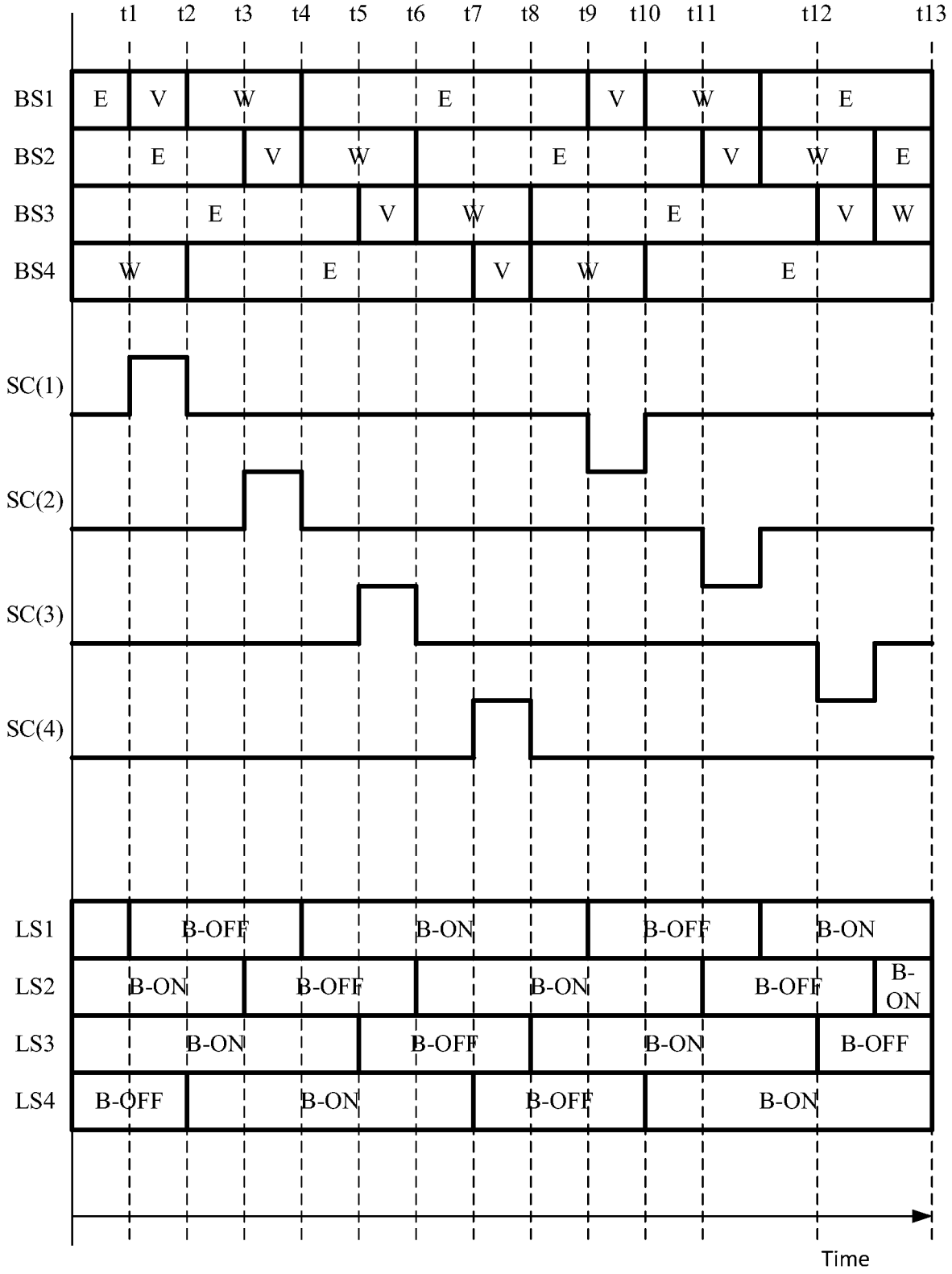
FIG. 9 illustrates an exemplary operation of a display device in accordance with another embodiment of the present disclosure.

In the paragraphs below, another exemplary operations of the display device 100 will be described with reference to FIG. 8 to FIG. 9.

In this operative embodiment, the pixel circuits 106 of the display device 100 can be divided into 4 operating blocks BS1 to BS4. Each of operating blocks BS1 to BS4 include a plurality rows (e.g. 2 rows) of pixel circuits 106. In this operative embodiment, the pixel circuits 106 of the operating blocks BS1 to BS4 implement the vertical electric field stage described above at different time periods, and then implement the data writing stage and the voltage maintaining stage respectively. It should be noted that, although each of operating blocks BS1 to BS4 with 2 rows of the pixel circuits 106 are used as the example for further illustration in this embodiment, however, the present disclosure is not limited to the examples described herein.

The pixel circuits 106 of the operating block BS1 implement the vertical electric field stage (marked as V) during the time periods t1 to t2, and implement the data writing stage (marked as W) during the time periods t2 to t4, and implement the voltage maintaining stage (marked as E)

during the time periods t4 to t9. During the time periods t1 to t2, the voltage SC(1) on the array-side electrode ACM of the pixel circuits 106 of the operating block BS1 has the first voltage levels described above. During the time periods t2 to t9, the voltage SC(1) on the array-side electrode ACM of the pixel circuits 106 of the operating block BS1 has the second voltage levels described above.

The pixel circuits 106 of the operating block BS2 implement the vertical electric field stage during the time periods t3 to t4, and implement the data writing stage during the time periods t4 to t6, and implement the voltage maintaining stage during the time periods t6 to t11. During the time periods t3 to t4, the voltage SC(2) on the array-side electrode ACM of the pixel circuits 106 of the operating block BS2 has the first voltage levels described above. During the time periods t4 to t11, the voltage SC(2) on the array-side electrode ACM of the pixel circuits 106 of the operating block BS2 has the second voltage levels described above.

The pixel circuits 106 of the operating block BS3 implement the vertical electric field stage during the time periods t5 to t6, and implement the data writing stage during the time periods t6 to t8, and implement the voltage maintaining stage during the time periods t8 to t12. During the time periods t5 to t6, the voltage SC(3) on the array-side electrode ACM of the pixel circuits 106 of the operating block BS3 has the first voltage levels described above. During the time periods t6 to t12, the voltage SC(3) on the array-side electrode ACM of the pixel circuits 106 of the operating block BS3 has the second voltage levels described above.

The pixel circuits 106 of the operating block BS4 implement the vertical electric field stage during the time periods t7 to t8, and implement the data writing stage during the time periods t6 to t10, and implement the voltage maintaining stage during the time periods t10 to t13. During the time periods t7 to t8, the voltage SC(4) on the array-side electrode ACM of the pixel circuits 106 of the operating block BS4 has the first voltage levels described above. During the time periods t8 to t13, the voltage SC(4) on the array-side electrode ACM of the pixel circuits 106 of the operating block BS4 has the second voltage levels described above.

On the other hand, in this embodiment, the display device 100 may further drive the backlight unit (referred to as the backlight unit BLU of FIG. 4 and FIG. 6) corresponding to the pixel circuits 106 of the different operating blocks BS1 to BS4 in a time-division manner to increase the luminous efficacy of the backlight unit.

More particularly, when the pixel circuits 106 of the operating block BS1 implement the vertical electric field stage described above and the data writing stage described above (e.g. during the time periods t1 to t4), the display device 100 controls the backlight unit LS1 corresponding to the operating block BS1 to be turned-off (marked as "B-OFF"). When the pixel circuits 106 of the operating block BS1 implement the voltage maintaining stage described above (e.g. during the time periods t4 to t9), the display device 100 controls the backlight unit LS1 corresponding to the operating block BS1 to be turned-on (marked as "B-ON").

When the pixel circuits 106 of the operating block BS2 implement the vertical electric field stage described above and the data writing stage described above (e.g. during the time periods t3 to t6), the display device 100 controls the backlight unit LS2 corresponding to the operating block BS2 to be turned-off (marked as "B-OFF"). When the pixel circuits 106 of the operating block BS2 implement the voltage maintaining stage described above (e.g. during the time periods t6 to t11), the display device 100 controls the backlight unit LS2 corresponding to the operating block BS2 to be turned-on (marked as "B-ON").

When the pixel circuits 106 of the operating block BS3 implement the vertical electric field stage described above and the data writing stage described above (e.g. during the time periods t5 to t8), the display device 100 controls the backlight unit LS3 corresponding the operating block BS3 to be lightless (marked as "B-OFF"). When the pixel circuits 106 of the operating block BS3 implement the voltage maintaining stage described above (e.g. during the time periods t8 to t12), the display device 100 controls the backlight unit LS3 corresponding the operating block BS3 to be turned-on (marked as "B-ON").

When the pixel circuits 106 of the operating block BS4 implement the vertical electric field stage described above and the data writing stage described above (e.g. during the time periods t7 to t10), the display device 100 controls the backlight unit LS4 corresponding the operating block BS4 to be lightless (marked as "B-OFF"). When the pixel circuits 106 of the operating block BS4 implement the voltage maintaining stage described above (e.g. during the time periods t10 to t13), the display device 100 controls the backlight unit LS4 corresponding the operating block BS4 to be turned-on (marked as "B-ON").

Through the operations above, the backlight units LS1 to LS4 can respectively generate light at the voltage maintaining stage corresponding to the operating blocks BS1 to BS4 to increase the luminous efficacy of the display device 100.

Figure 10:
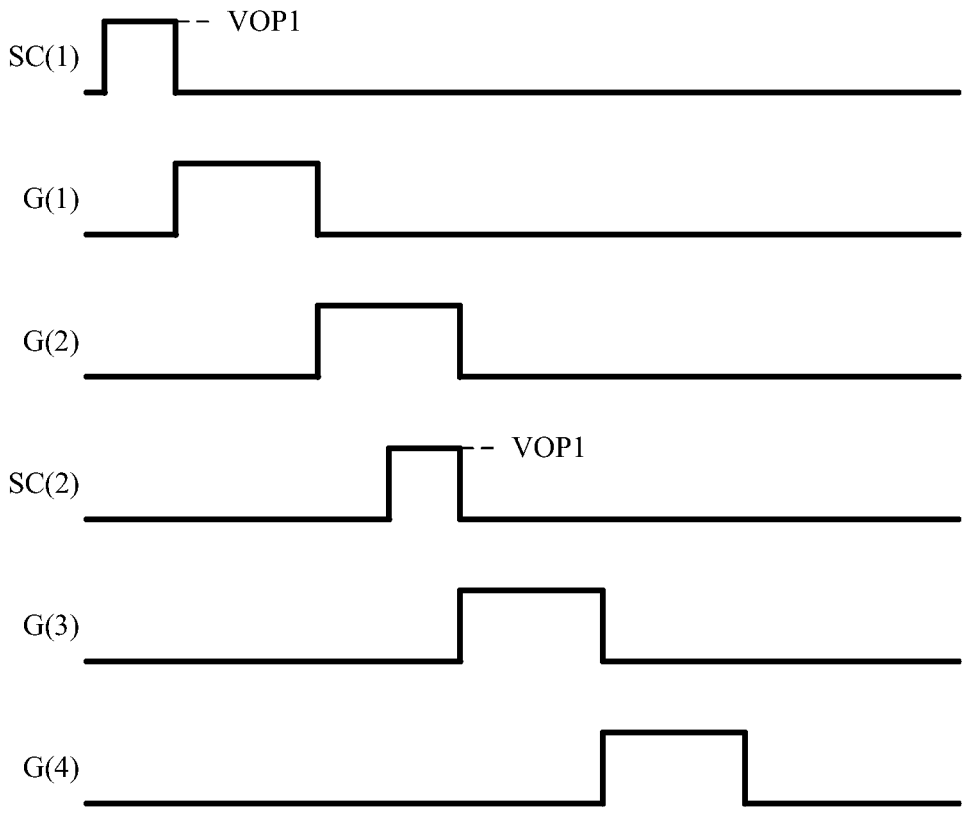
FIG. 10 illustrates signals of a display device in accordance with another embodiment of the present disclosure.

Furthermore, refer to FIG. 10, in the operative embodiment described above, when the vertical electric field stage described above of the operating block BS1 is implemented, the display device 100 may simultaneously provide the first operating voltage VOP1 to each pixel circuit 106 of the operating block BS1 to make the display components LC corresponding to the operating block BS1 erect at the same time. When the data writing stage described above of the operating block BS1 is implemented, the display device 100 can provide the gate signals G(1) and G(2) row by row to the pixel circuits 106 of the operating block BS1 to make the display components LC of the operating block BS1 twist row by row.

Similarly, when the vertical electric field stage described above of the operating block BS2 is implemented, the display device 100 may simultaneously provide the first operating voltage VOP1 to each pixel circuit 106 of the operating block BS2 to make the display components LC corresponding the operating block BS2 erect at the same time. When the data writing stage described above of the operating block BS2 is implemented, the display device 100 can provide the gate signals G(3) and G(4) row by row to the pixel circuits 106 of the operating block BS2 to make the display components LC of the operating block BS2 twist row by row.

Figure 11:
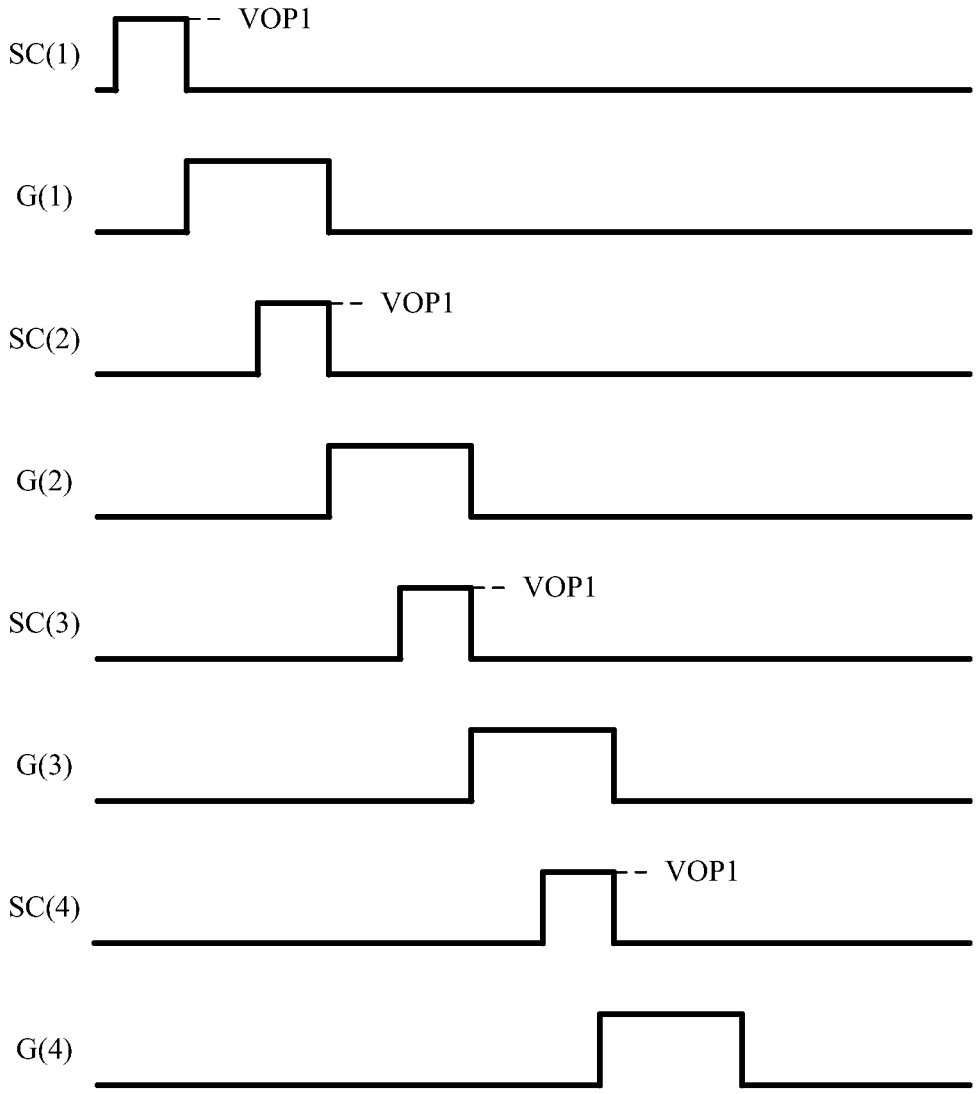
FIG. 11 illustrates signals of a display device in accordance with one embodiment of the present disclosure.

Refer to FIG. 11, in one embodiment, each of operating blocks BS1 to BS4 can only include a single row of the pixel circuits 106. In this embodiment, the display device 100 can provide the first operating voltage VOP1 to the pixel circuits 106 row by row to have the pixel circuits 106 implementing the vertical electric field stage row by row. Furthermore, the display device 100 can provide the gate signals G(1) to G(4) row by row to the pixel circuits 106 to make the display components LC twist row by row.

Although the present invention has been described in considerable detail with reference to certain embodiments thereof, other embodiments are possible. Therefore, the scope of the appended claims should not be limited to the description of the embodiments contained herein.

What is claimed is:

1. A pixel circuit comprising:

a storage capacitor;

a first switch electrically connected to a first end of the storage capacitor and configured to provide a data voltage to the first end of the storage capacitor according to a gate signal; and a second switch electrically connected between the first end of the storage capacitor and a second end of the storage capacitor, and configured to receive a first operating voltage from the second end of the storage capacitor and provide the first operating voltage to the first end of the storage capacitor.

2. The pixel circuit as claimed in claim 1, wherein the storage capacitor is disposed between a pixel electrode and an array-side electrode.

3. The pixel circuit as claimed in claim 2, wherein under a condition that the second switch provides the first operating voltage to the first end of the storage capacitor, a plurality of display components disposed between the pixel electrode and a counter electrode erect relative to the pixel electrode according to an electric field between the pixel electrode and the counter electrode.

4. The pixel circuit as claimed in claim 1, wherein under a condition that the data voltage is provided to the first end of storage capacitor, the first operating voltage is not provided to the second end of the storage capacitor, and under a condition that the first operating voltage is provided to the second end of the storage capacitor, the data voltage is not provided to the first end of the storage capacitor.

5. The pixel circuit as claimed in claim 1, wherein the second switch is further configured to receive a second operating voltage from the second end of the storage capacitor and provide the second operating voltage to the first end of the storage capacitor, wherein the voltage levels of the second operating voltage and the first operating voltage are different.

6. The pixel circuit as claimed in claim 1, wherein during a first stage, the first switch is turned off and the second switch is turned on to make the first operating voltage on the second end of the storage capacitor be provided to the first end of the storage capacitor via the second switch.

7. The pixel circuit as claimed in claim 6, wherein during a second stage, the first switch is turned on and the second switch is turned off to make the data voltage be provided to the first end of the storage capacitor via the first switch.

8. A pixel circuit comprising:

a pixel electrode;

an array-side electrode, wherein the pixel electrode and the array-side electrode is disposed at a first side of a display layer;

a first switch configured to provide a data voltage to the pixel electrode; and a second switch electrically connected between the pixel electrode and the array-side electrode, and configured to provide a first operating voltage on the array-side electrode to the pixel electrode to make axial directions of a plurality of display components in the display layer be substantially perpendicular to the pixel electrode.

9. The pixel circuit as claimed in claim 8, wherein under a condition that the second switch provides the first operating voltage to the pixel electrode, an electric field between the pixel electrode and a counter electrode makes axial directions of the plurality of display components in the display layer be in a same direction with the electric field, wherein the counter electrode is disposed at a second side of the display layer.

10. The pixel circuit as claimed in claim 8, wherein under a condition that the data voltage is provided to the pixel electrode, the first operating voltage is not provided to the array-side electrode, and under a condition that the first operating voltage provides to the array-side electrode, the data voltage is not provided to the pixel electrode.

11. The pixel circuit as claimed in claim 8, wherein the second switch is further configured to receive a second operating voltage from the array-side electrode and provide the second operating voltage to the pixel electrode, wherein the voltage levels of the second operating voltage and the first operating voltage are different.

12. The pixel circuit as claimed in claim 11, wherein the first operating voltage and the second operating voltage are configured to be alternatively provided to the array-side electrode.

13. The pixel circuit as claimed in claim 8, wherein during a first stage, the first switch is turned off and the second switch is turned on to make the first operating voltage of the array-side electrode be provided to the pixel electrode via the second switch.

14. The pixel circuit as claimed in claim 13, wherein during a second stage, the first switch is turned on and the second switch is turned off to make the data voltage be provided to the pixel electrode via the first switch.

15. A display device comprising:

a display layer;

a pixel electrode;

an array-side electrode, wherein the pixel electrode and the array-side electrode are disposed at a first side of a display layer, and there is a storage capacitor between the pixel electrode and the array-side electrode;

a first switch configured to provide a data voltage to the pixel electrode; and a second switch electrically connected between the pixel electrode and the array-side electrode, and configured to provide a first operating voltage on the array-side electrode to the pixel electrode to make axial directions of a plurality of display components in the display layer be substantially perpendicular to the pixel electrode.

16. The display device as claimed in claim 15 further comprising:

a counter electrode disposed at a second side of the display layer, wherein under a condition that the second switch provides the first operating voltage to the pixel electrode, an electric field between the pixel electrode and the counter electrode makes axial directions of a plurality of display components in the display layer be in a same direction with the electric field.

17. The display device as claimed in claim 15, wherein under a condition that the data voltage is provided to the pixel electrode, the first operating voltage is not provided to the array-side electrode, and under a condition that the first operating voltage is provided to the array-side electrode, the data voltage is not provided to the pixel electrode.

18. The display device as claimed in claim 15, wherein the second switch is further configured to receive a second operating voltage from the array-side electrode and provide the second operating voltage to the pixel electrode, wherein the voltage levels of the second operating voltage and the first operating voltage are different, and the first operating voltage and the second operating voltage is alternatively provided to the array-side electrode.

19. The display device as claimed in claim 15, wherein during a first stage, the first switch is turned off and the second switch is turned on to make the first operating voltage of the array-side electrode be provided to the pixel electrode via the second switch.

20. The display device as claimed in claim 19, wherein during a second stage, the first switch is turned on and the second switch is turned off to make the data voltage be provided to the pixel electrode via the first switch.

* * * * *